US010365610B2

(12) United States Patent
Zaugg et al.

(10) Patent No.: US 10,365,610 B2
(45) Date of Patent: Jul. 30, 2019

(54) DISPLAY MECHANISM WITH ROLLERS FOR WATCHES

(71) Applicant: Montres Breguet S.A., L'Abbaye (CH)

(72) Inventors: Alain Zaugg, Le Sentier (CH); Eric Goeller, Colombier (CH)

(73) Assignee: Montres Breguet S.A., L'Abbaye (CH)

( * ) Notice: Subject to any disclaimer, the term of this patent is extended or adjusted under 35 U.S.C. 154(b) by 94 days.

(21) Appl. No.: 15/636,031

(22) Filed: Jun. 28, 2017

(65) Prior Publication Data

US 2018/0011444 A1 Jan. 11, 2018

(30) Foreign Application Priority Data

Jul. 5, 2016 (EP) ..... 16177872

(51) Int. Cl.

| | |
|---|---|
| ***G04B 19/20*** | (2006.01) |
| ***G04B 19/21*** | (2006.01) |
| ***G04B 19/243*** | (2006.01) |
| *G09F 11/04* | (2006.01) |
| *G09F 11/06* | (2006.01) |

(52) U.S. Cl.

CPC ..... *G04B 19/21* (2013.01); *G04B 19/20* (2013.01); *G04B 19/205* (2013.01); *G04B 19/207* (2013.01); *G04B 19/24386* (2013.01); *G04B 19/24393* (2013.01); *G09F 11/04* (2013.01); *G09F 11/06* (2013.01)

(58) Field of Classification Search

CPC ..... G04B 19/20; G04B 19/205; G04B 19/21; G04B 19/24386; G04B 19/24393; G09F 11/04; G09F 11/06

See application file for complete search history.

(56) References Cited

U.S. PATENT DOCUMENTS

| | | | | |
|---|---|---|---|---|
| 1,205,841 A * | 11/1916 | Barnett | ..... | G09F 11/06 40/475 |
| 2,040,421 A | 5/1936 | Almquist | | |
| 3,780,524 A | 12/1973 | Boyles | | |
| 3,822,808 A * | 7/1974 | Katakura | ..... | B67D 7/26 222/33 |

(Continued)

FOREIGN PATENT DOCUMENTS

| | | |
|---|---|---|
| CH | 707 103 A1 | 3/2014 |
| FR | 1 602 382 | 11/1970 |
| FR | 2 220 840 | 10/1974 |

OTHER PUBLICATIONS

European Search Report dated Feb. 21, 2017 in European application 16177872.5, filed on Jul. 5, 2016 (with English Translation of Categories of Cited Documents).

*Primary Examiner* — Daniel P Wicklund

(74) *Attorney, Agent, or Firm* — Oblon, McClelland, Maier & Neustadt, L.L.P.

(57) ABSTRACT

A timepiece display mechanism for a watch includes a roller pivoting about a main axis and including flaps, each pivoting about a secondary axis parallel to the main axis and having two faces, a first driver for pivoting the roller about the main axis, and a second driver for pivoting a flap about its secondary axis, in a determined position of this secondary axis relative to the main axis, and which include, at each flap, a drive pinion cooperating with a controller to modify, in sequence or continuously, the position of the successive flaps of the same roller or to modify, on demand, the position of a specific flap.

14 Claims, 7 Drawing Sheets

(56) References Cited

U.S. PATENT DOCUMENTS

| | | | | | |
|---|---|---|---|---|---|
| 3,964,428 | A | | 6/1976 | Arai | |
| 4,057,957 | A | * | 11/1977 | Kimura | G04C 21/16 368/263 |
| 4,060,972 | A | * | 12/1977 | Kimura | G04B 19/205 200/35 R |
| 4,108,355 | A | * | 8/1978 | Yaguinuma | G09F 11/06 235/1 C |

* cited by examiner

DISPLAY MECHANISM WITH ROLLERS FOR WATCHES

This application claims priority from European Patent Application No. 16177872.5 filed on Jul. 5, 2016, the entire disclosure of which is hereby incorporated herein by reference.

FIELD OF THE INVENTION

The invention concerns a timepiece display mechanism comprising at least one roller pivoting about a roller axis, the roller comprising at least one flap pivoting about a flap axis parallel to the roller axis and distinct from the roller axis, said at least one flap comprising at least one first face and at least one second face, the display mechanism comprising first drive means for pivoting the roller about the roller axis, wherein said display mechanism includes second drive means, distinct from said first drive means, for pivoting at least one said flap about its said flap axis, in at least one determined position of said flap axis with respect to said roller axis.

The invention also concerns a watch including at least one such display mechanism.

The invention concerns the field of timepiece display mechanisms, particularly for watches, and more specifically calendar display mechanisms.

BACKGROUND OF THE INVENTION

The legibility of displays is a major preoccupation in horology, especially for calendar type displays, which are difficult to make in formats that are easy for the user to see and decipher.

Timepiece displays are rarely made using rollers since indications taking this form require high thickness due to the diameter of the roller, comprising, for example, up to 31 indications for the days of the month, or 52 indications for the weeks of the year, and are incompatible with the specific geometry of a watch.

Also, the possible use of characters of very small size requires the use of magnifying lenses in the thickness of the watch crystal, which is highly detrimental to the aesthetic appearance of the watch, while remaining difficult to read.

Static displays using flaps or blades for miniature and other clocks, are difficult to transpose to watches since they generally rely on gravity. They are more fragile and cannot withstand shocks.

U.S. Pat. No. 3,964,428 in the name of ARAI KIYOYUKI describes an indicator with rotating flaps having two sides, at the periphery of a rotating drum, with means for guiding the flaps, held in a tangential orientation. During rotation of the drum, a mechanism allows the flaps to be overturned about their axis.

SUMMARY OF THE INVENTION

The invention proposes to develop a display using rollers, with time indications that are legible despite the limited diameter of the rollers.

To this end, the invention concerns a timepiece display mechanism.

The invention also concerns a watch including at least one such display mechanism.

BRIEF DESCRIPTION OF THE DRAWINGS

Other features and advantages of the invention will appear upon reading the following detailed description, with reference to the annexed drawings, in which:

FIG. 22, in perspective, showing a triple hand at 120°, in the extension of the month roller axis;

FIG. 23 in a cross-section perpendicular to this axis, shows a star, held by a jumper, which drives the triple hand;

FIGS. 24 and 25 show, in a similar manner to FIG. 23, but without representing the jumper, the cooperation of the star, for the driving thereof, via an off-centre lever integral with a flap;

FIG. 26 is an end view, from the triple hand side.

DETAILED DESCRIPTION OF PREFERRED EMBODIMENTS

The invention is illustrated in the Figures, in a non-limiting manner, with rollers for the days of the week, for the date (a tens roller and a units roller), and for the months.

Figure 1:
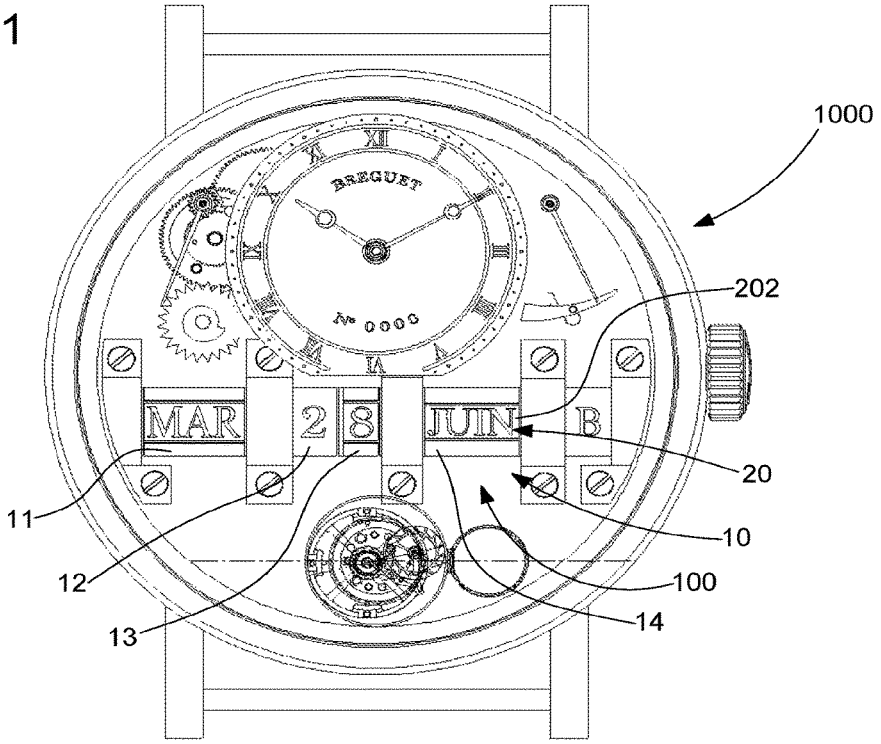
FIG. 1 shows a schematic, front view of a watch including a roller display mechanism according to the invention, of the calendar type.

FIG. 1 illustrates, for example, in a non-limiting manner, a watch comprising rollers, with a character height greater than 2.20 mm, on a roller of 5.00 mm diameter.

Thus, the invention concerns a timepiece display mechanism 100 comprising at least one roller 10, bearing difference references in the Figures: 11, 12, 13, 14, pivoting about a roller axis D10. This roller 10, 11, 12, 13, 14 includes at least one flap 20, which is mounted to pivot about a flap axis D20 parallel to roller axis D10 and distinct from roller axis D10. This at least one flap 20 includes at least one first face 201 and at least one second face 202, arranged so that the user can see only one of these faces at any given time.

Display mechanism 100 includes first drive means 31 for pivoting roller 10, 11, 12, 13, 14 about roller axis D10.

This display mechanism 100 includes second drive means 32, distinct from first drive means 31, for pivoting at least one such flap 20 about its flap axis D20, in at least one determined position of flap axis D20 relative to roller axis D10.

More particularly, in display mechanism 100, a constant rotation of flaps 20 is calculated, as a function of rollers 10, 11, 12, 13, 14, so that, in the display position visible to the user, the indication of flap 20 is rotated by 180° per revolution of roller 10, 11, 12, 13, 14.

More particularly, the second drive means 32 are arranged to pivot only one flap 20 at a time, independently of the other flaps 20 comprised in a roller 10, 11, 12, 13, 14.

In another variant, second drive means 32 are arranged to pivot synchronously each flap 20 comprised in a roller 10, 11, 12, 13, 14. This makes it possible to save the energy required for the display mechanism.

In the variant that is preferred since it uses less space, wherein second drive means 32 are arranged to pivot only one flap 20 at a time, more particularly, second drive means 32 are arranged to pivot the single flap 20 in only one specific position of flap axis D20 relative to roller axis D10.

According to the invention, second drive means 32 include, at each flap 20, at least one flap drive pinion 35, 35', centred on flap axis D20. This flap drive pinion 35 is more particularly arranged to cooperate with a control means, comprised in display mechanism 100, to modify, in sequence or continuously, the position of the successive flaps 20 of the same roller 10, 11, 12, 13, 14, or to modify on demand the position of a specific flap 20. It is therefore possible to modify, on demand, the position of a specific flap.

More particularly, motorisation of second drive means 32, or control via a watch stem, or a push-piece, or a pull-out piece, facilitates the updating of a calendar when the watch has stopped for an extended period.

More particularly, to hold each flap 20 in an orientation position, each includes a flap cam 25, particularly a heart-piece, comprising as many low points 26 as flap 20 has faces 201, 202. Roller 10, 11, 12, 13, 14 preferably includes at least one spring 15, which is arranged to exert a force on a jumper 17 disposed in proximity to each flap cam for indexing the position of said flap cam 25, as seen in FIGS. 9 and 11.

Figure 9:
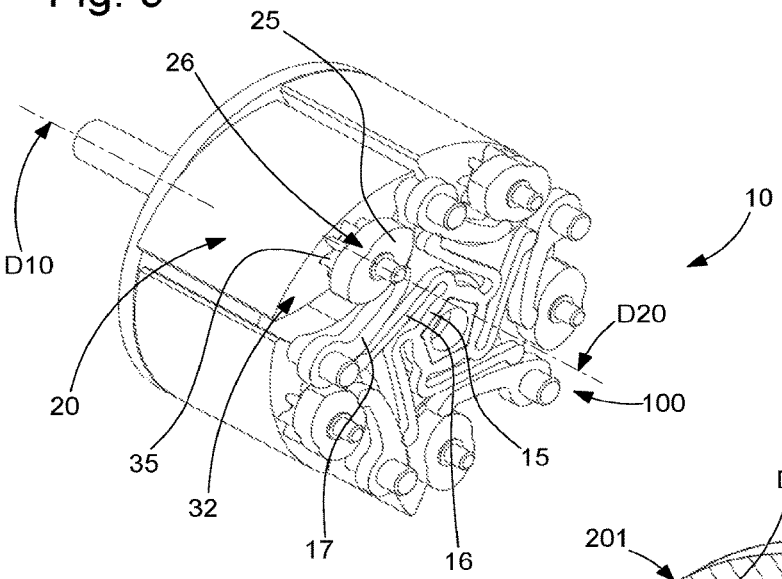
FIG. 9 represents a schematic, perspective view of the units roller of FIG. 7.
Figure 10:
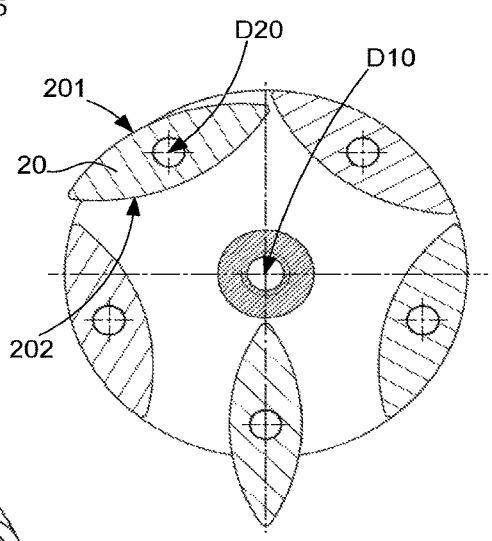
FIGS. 10 and 11 schematically represent, in a cross-sectional view and end view respectively, in a plane perpendicular to the axis of rotation of the roller, the units roller of FIG. 7, in an intermediate position, with, also visible in FIG. 9, the representation of a spring arranged to exert a force on jumpers disposed in proximity to flap cams for indexing the position of these cams and of the corresponding flaps.
Figure 11:
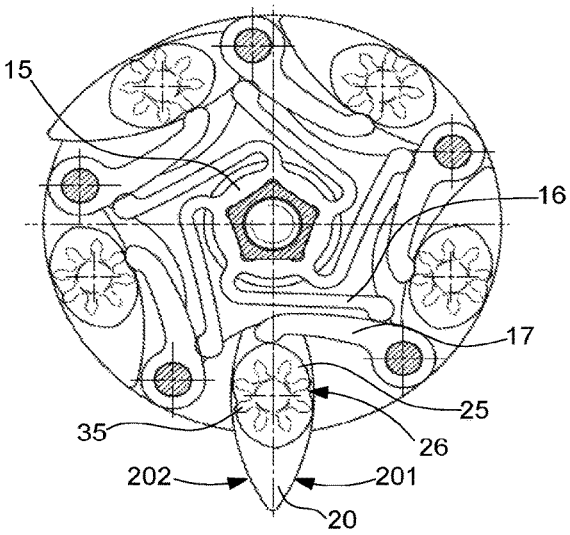
Figure 21:
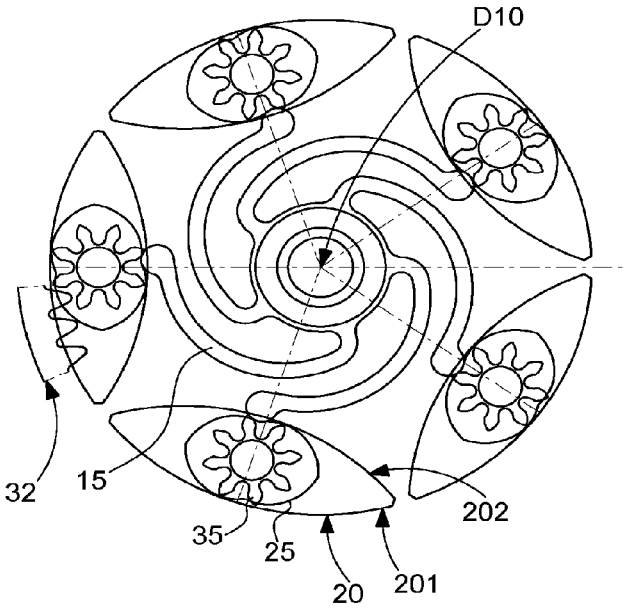
FIG. 21 represents, in a similar manner to FIG. 5, a variant wherein indexing of the position of the flap cams is effected by a single spring also serving as a jumper.
Figure 22:
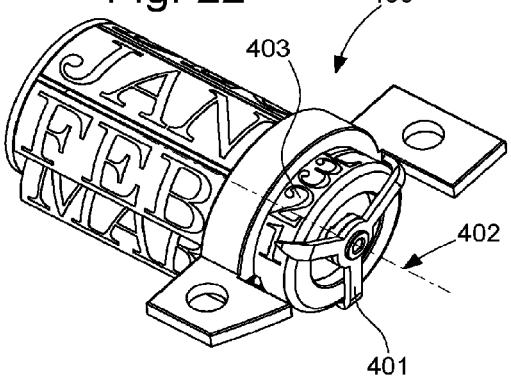
FIGS. 22 to 26 schematically represent a variant for the display of leap years.
Figure 23:
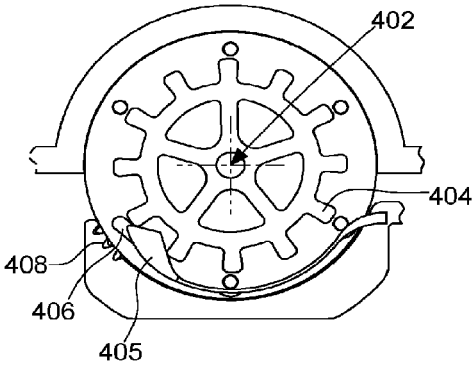

In a particular variant, as seen in FIG. 21, the pair formed by this jumper and spring is advantageously replaced by at least one spring 15 of special shape, particularly a single spring as illustrated, combining the two functions of spring and jumper, and which replaces all the jumpers 17 of the variant of FIGS. 9 and 11.

Figure 17:
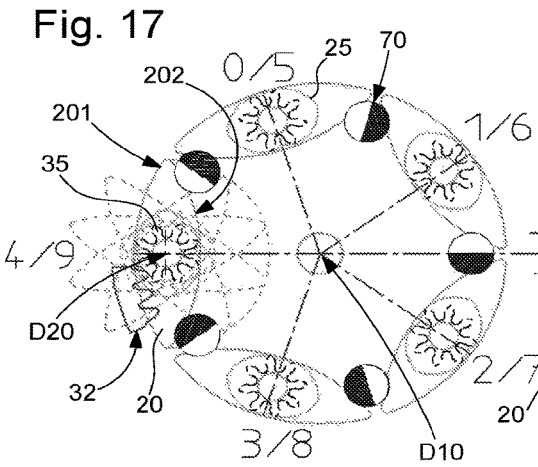
FIG. 17 represents, in a similar manner to FIG. 7, another variant of the units roller of FIG. 2, showing the means for driving and for the magnetic holding of the flaps, with the pivoting kinematics of one of the roller flaps shown in dotted lines.

In a variant of similar functionality, more particularly, to hold each flap 20 in an orientation position, each includes a flap cam 25 or a heart-piece comprising as many low points 26 as flap 20 has faces 201, 202, and roller 10, 11, 12, 13, 14 includes, for each flap cam 25 or heart-piece, at least one magnet 70 arranged to exert a force on the flap cam 25 or heart-piece made of magnetic material to index the position of the flap cam 25 or heart-piece, as seen in FIG. 17.

Figure 3:
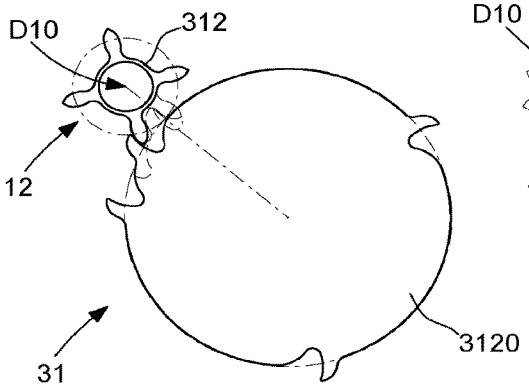
FIG. 3 represents, in a similar manner to FIG. 1, the gear train driving the tens roller of FIG. 2.
Figure 4:
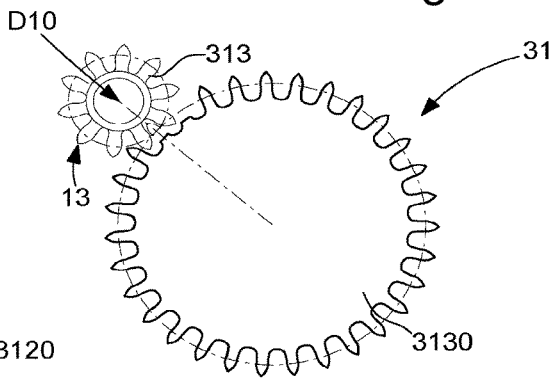
FIG. 4 represents, in a similar manner to FIG. 1, the gear train driving the units roller of FIG. 2.

More particularly, the first drive means 31 include, as seen in FIGS. 3 and 4, a control wheel 3120, 3130 some of whose teeth have been removed, and which meshes with a roller drive pinion 312, 313, either directly, or via a reduction gears 3131, to obtain the desired reduction. This makes it possible, in particular, to display the date.

Figure 16:
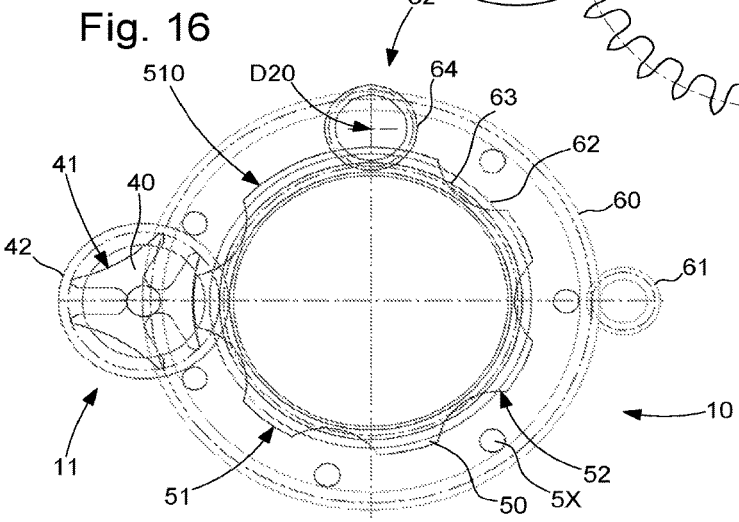
FIG. 16 represents, in a similar manner to FIG. 15, the rotational control of a particular roller with seven indications, corresponding to the days of the week.

More particularly, at least one roller 10, 11, 12, 13, 14 has at least one fixed display position and at least one mobile display position via a flap 20 comprising a plurality of faces 201, 202, as seen in FIG. 16. This makes it possible to produce a roller display with all sorts of indications in a reduced volume.

More particularly, first drive means 31 include an input train 61 which drives a main wheel 60, one revolution of which corresponds to the display time period of roller 10, 11, 12, 13, 14, and which carries a main cam 50 carrying peripheral sectors 51 separated by recesses 52, peripheral sectors 51 being of unequal amplitude, the shortest corresponding to the fixed display positions, and the longest corresponding to the mobile display positions. Main cam 50 cooperates with an off-centre, secondary Maltese cross cam 40 arranged to pivot upon passage of a recess 52. Secondary cam 40 carries a secondary wheel 42 meshing with a roller drive wheel 62. Main wheel 60 also carries a main flap drive wheel 63, which in turn meshes with a flap pinion 64, which is arranged to control a flap drive pinion 35 centred on flap axis D20 or actually forming such a flap drive pinion 35.

The invention also concerns a watch 1000 including at least one such display mechanism 100.

The Figures illustrate particular embodiments of the invention.

Figure 2:
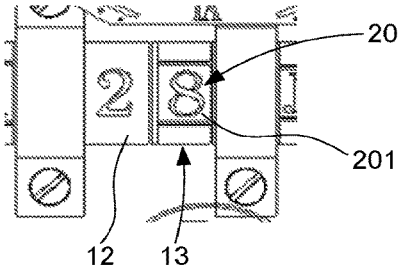
FIG. 2 represents, in a similar manner to FIG. 1, a date display on a tens roller and a units roller having flaps according to the invention.

FIG. 2 illustrates a date display on a roller. Since 31 days cannot be displayed on the circumference of a roller of 5 mm diameter, or similar, the units and tens are distributed over two rollers: four numbers on a tens roller 12, and ten numbers on a units roller 13.

The two rollers are driven by two control wheels 3120 and 3130, each having 31 teeth, some of whose teeth have been removed in correspondence with days where rotation of the respective roller is unnecessary.

FIG. 3 shows the drive train for tens roller 12: first drive means 31 include a first control wheel 3120, which has only four teeth present of the 31 theoretical teeth, to drive the four teeth of a four-tooth star wheel 312 driving tens roller 12. A jumper (not represented in the drawing) is required to maintain the position of four-tooth star wheel 312, and to finish the drive function.

FIG. 4 shows the drive train for units roller 13: first drive means 31 include a second control wheel 3130, which includes only some of the 31 theoretical teeth, according to the display type created, for driving the ten teeth of a units pinion 313 driving units roller 13. The second control wheel 3130 may therefore include either thirty teeth or, as here, twenty-nine teeth, with the two missing teeth making it possible to cancel rotation of the units on the change from 31 to 01. A jumper (not represented in the drawing) is required to maintain the position of the ten-tooth units pinion 313, and to maintain the display position.

These drive principles are similar to the well-known principles of large aperture date displays.

Figure 5:
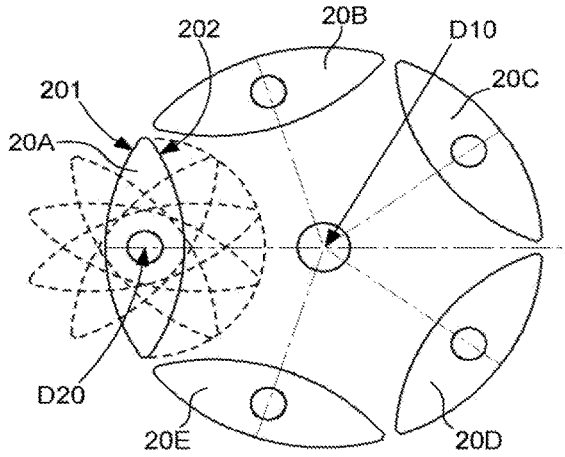
FIG. 5 schematically represents an end view, in a plane perpendicular to the axis of rotation of the roller, of the units roller of FIG. 2, with the pivoting kinematics of one of the flaps of this roller shown in dotted lines.
Figure 6:
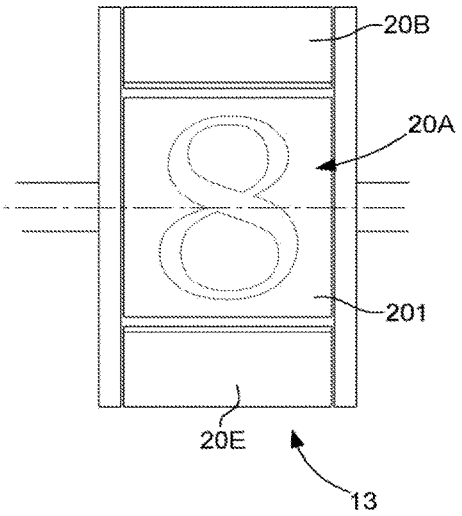
FIG. 6 represents, in a similar manner to FIG. 1, a detail of the units roller of FIG. 5.
Figure 7:
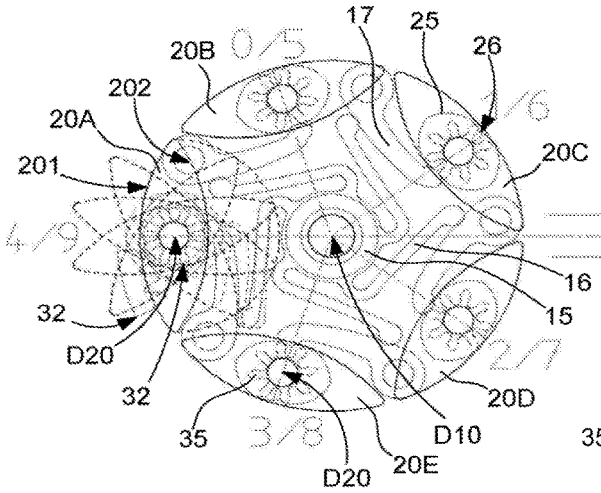
FIG. 7 represents, in a similar manner to FIG. 5, a variant of the units roller of FIG. 2, showing the means for driving and holding the flaps, with the pivoting kinematics of one of the roller flaps shown in dotted lines.
Figure 8:
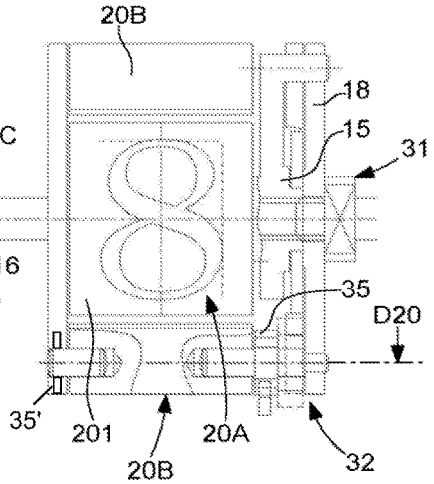
FIG. 8 represents, in a similar manner to FIG. 1, a detail of the units roller of FIG. 7.

FIGS. 5 and 6 illustrate the units display on a units roller 13. The ten units distributed over the circumference of a roller of 5 mm diameter does not allow for sufficiently large character dimensions. Therefore, units roller 13 according to the invention includes several flaps 20A, 20B, 20C, 20D, 20E, each carrying on its at least two opposite faces 201, 202, at least two of the units numbers. In this example, units roller 13 is thus divided, and five flaps 20 with two faces bear the ten units. These flaps 20 present their two faces 201 and 202 alternately to the user, and make it possible to double the height of the units characters.

FIGS. 7 to 11 illustrate the rotation and holding in place of flaps 20 during the rotation of carrier roller 10, and during their own rotation.

Flaps 20 may be driven in continuous rotation relative to the rotation of roller 10, with a ratio of one-half. This solution is simple but requires space over the entire circumference of roller 10, which is not always possible.

To limit the space occupied by the system, it is advantageous to utilise the solution described below, which controls a rotation of a flap 20 at only one point on the circumference of roller 10. Each flap 20 is thus held in position by a jumper 17, which collaborates with a flap cam 25, particularly of the heart-piece type, having two positions, mounted on the axis of the flap concerned, whose low point 26 cooperates with a protruding portion of jumper 17. A spring 15, especially, as in FIG. 7, a spring with multiple arms, applies a force on jumper 17 which maintains the position of flap 20. A pinion 35 is also mounted on the axis of flap 20.

This pinion may be driven by a gear train comprised in second drive means 32 (not illustrated in the Figures). In the particular variant of FIG. 7, second drive means 32 include a fixed segment of toothing, located at one point on the periphery of roller 10. During rotation of roller 10, a flap pinion 35 comes into contact and cooperates with this segment, which causes a 180° rotation of the flap 20 concerned.

Figure 12:
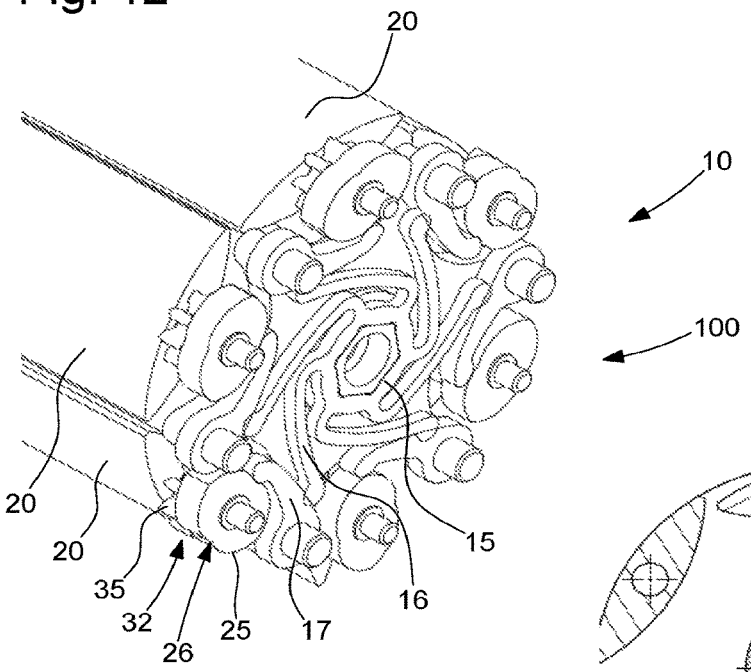
FIGS. 12 to 14 represent, in a similar manner to FIGS. 9 to 11, a month roller according to the invention.
Figure 13:
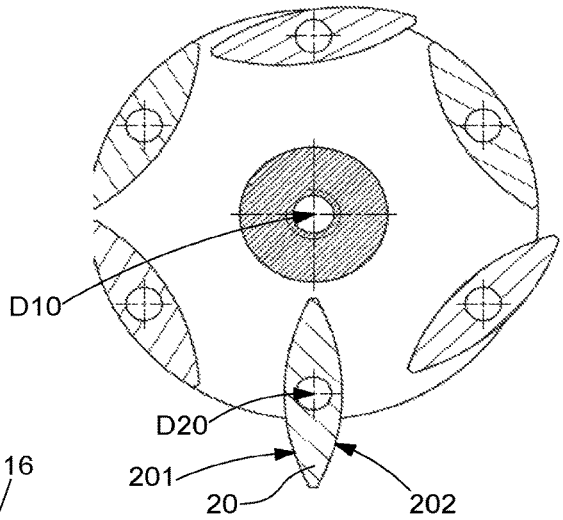
Figure 14:
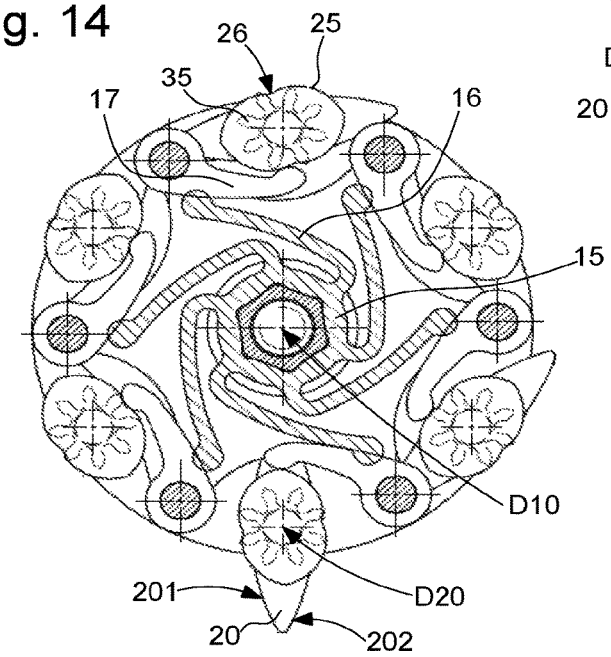

FIGS. 12 to 14 illustrate, in a similar manner, the rotation of a month roller comprising six flaps 20. Naturally, to achieve twelve indications over the circumference, it is also possible to use four flaps with three faces, or three flaps with four faces.

Figure 15:
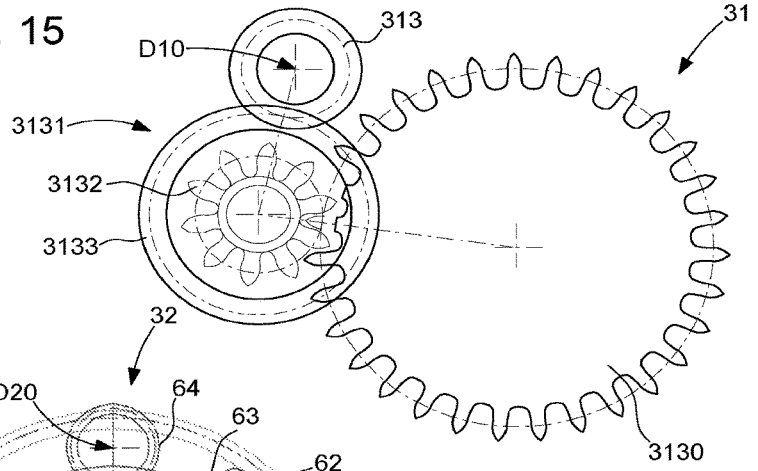
FIG. 15 represents, in a similar manner to FIGS. 3 and 4, the rotation of a units roller with five flaps.

FIG. 15 illustrates the rotation of a units roller with five flaps. As explained above, the rotation of a units roller can be achieved with a 31-tooth wheel with one or two teeth missing for the passage of a ten-tooth pinion. For a rotation of ⅕th of a revolution per day, for a roller with five flaps, the ten-tooth pinion should be reduced to five teeth, however, geometrically this reduction is not possible with the function. It is therefore necessary to add a gear reduction with a pair of reduction gears: 3132, 3133, corresponding to the desired reduction. In this example, the different wheels of the gear train effect:

3130 with 31 teeth: 1 revolution per month
3132 with 10 teeth: 1 revolution every 10 days
3133 with 20 teeth: 1 revolution every 10 days
313 with 10 teeth: 1 revolution every 5 days.

In a particular embodiment with a Maltese cross, first drive means 31 include an input train 61 which drives a main wheel 60, one revolution of which corresponds to the display time period of roller 10, 11, 12, 13, 14, and which carries a main cam 50 carrying peripheral sectors of unequal geometry, concentric sectors 51 corresponding to the fixed display positions, and recessed sectors 52 provided with drive pins 5X corresponding to the mobile positions of display roller 10, 11, 12, 13, 14. This main cam 50 cooperates with an off-centre, secondary Maltese cross cam 40, pivoting about a fixed point and arranged to pivot upon passage of a recess 52 and of a pin 5X. This secondary cam 40 carries a secondary wheel 42 meshing with a roller drive wheel 62, and main wheel 60 also carries a main flap drive wheel 63, which in turn meshes with a flap pinion 64, arranged to control a flap drive pinion 35 centred on flap axis D20 or actually forming a flap drive pinion 35.

More particularly, FIG. 16 illustrates a particular variant of this Maltese cross embodiment, for controlling the rotation of a roller with seven indications, corresponding to the days of the week. In the case of the days of the week, since the number of days is a prime number, it is not possible to distribute it over flaps as simply as before. If the roller cannot display seven days over the circumference, the solutions are limited:

- roller with six fixed positions and one flap with two faces;
- roller with five fixed positions and two flaps with two faces;
- roller with four fixed positions and three flaps with two faces;
- roller with one fixed position and two flaps with three faces.

FIG. 16 describes the first variant of a roller with six fixed positions and one flap with two faces. Adaptation to the other variants can be achieved in a similar manner. First drive means 31 include an input train 61, which drives a main wheel 60, one revolution of which corresponds to the display time period of roller 10, in the application to the display of the days of the week, this main wheel 60 is driven through ⅐th of a revolution per day.

More generally, for a display of N periods, main wheel 60 is driven through 1/Nth of a revolution per day.

Main wheel 60 carries a main cam 50, which is separated into N different peripheral sectors. These peripheral sectors are of unequal geometry: concentric sectors 51 correspond to the fixed display positions, and recessed sectors 52 provided with drive pins 5X correspond to the mobile positions of the display roller. Further, the angular amplitude of concentric sectors 51 may be variable, as will be seen below.

This main cam 50 cooperates with a secondary, Maltese cross cam 40, via the aforementioned pins and notches. This secondary cam 40 is off-centre, pivots about a fixed point, and is arranged to pivot upon passage of a recess 52 and of a pin 5X.

This secondary cam 40 carries a secondary wheel 42 which meshes with a roller drive wheel 62, integral with the display roller 10 concerned.

Secondary, Maltese cross cam 40 thus drives roller drive wheel 62 through ⅙th of a revolution, six out of seven days, which corresponds to the six fixed positions of the roller.

On the seventh day, the shoulder 41 of secondary, Maltese cross cam 40 remains resting on the longest 510 of concentric sectors 51, and secondary, Maltese cross cam 40 therefore cannot pivot. Roller drive wheel 62 is not driven, and the roller thus remains immobile.

Main wheel 60 also carries a main flap drive wheel 63, which in turn meshes with a flap pinion 64, arranged to control a flap drive pinion 35 centred on flap axis D20 or actually forming a flap drive pinion 35.

This main flap drive wheel 63, like main wheel 60, makes ⅐th of a revolution per day.

Flap pinion 64 carries the flap 20 with two faces, and meshes with a ratio of 3.5 with main flap drive wheel 63.

Thus, when roller drive wheel 62 is immobile, and main wheel 60 makes 1/7th of a revolution, flap pinion 64 makes ½ a revolution, and flap 20 changes sides.

When roller drive wheel 62 is released and makes 1/6th of a revolution and main wheel 60 makes 1/7th of a revolution, flap pinion 64 makes 1/12th of a revolution, thus in six days it will return to its starting point.

Figure 18:
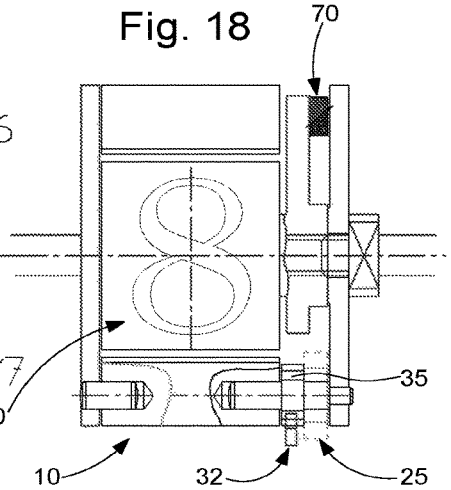
FIG. 18 represents, in a similar manner to FIG. 8, a detail of the units roller of FIG. 17.

FIGS. 17 and 18 illustrate an advantageous variant of the invention, wherein the jumpers and the spring ensuring that the flaps are held in position are replaced by magnets 70 which exert a force, particularly a force of attraction, on the cams made of magnetic material.

In another particular embodiment with partial toothings, in place of the Maltese cross systems described above, first drive means 31 include an input train 61 which drives a main wheel 60, one revolution of which corresponds to the display time period of roller 10, 11, 12, 13, 14, and which carries a main cam 50 carrying peripheral sectors of unequal geometry: concentric sectors 51 corresponding to the fixed display positions, and sectors including drive means 53 close to recesses 52. Main cam 50 cooperates with an off-centre star 71, pivoting about a fixed point, and arranged to pivot upon passage of such a drive means 53, and to remain in its angular position when two teeth 72 comprised therein are resting on a concentric sector 51. This star 71 carries a secondary wheel 70 which meshes with a roller drive wheel 62, integral with the roller 10, 11, 12, 13, 14. As previously, main wheel 60 carries a main flap drive wheel 63, which in turn meshes with a flap pinion, arranged to control a flap drive pinion 35 centred on flap axis D20 or actually forming a flap drive pinion 35.

Figure 19:
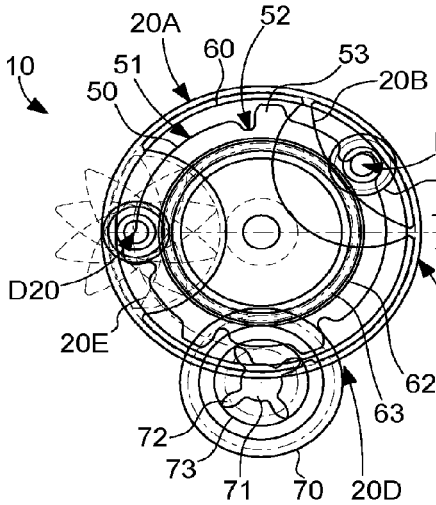
FIGS. 19 and 20 illustrate another variant, which includes partial toothings instead of the Maltese cross systems described above.
Figure 20:
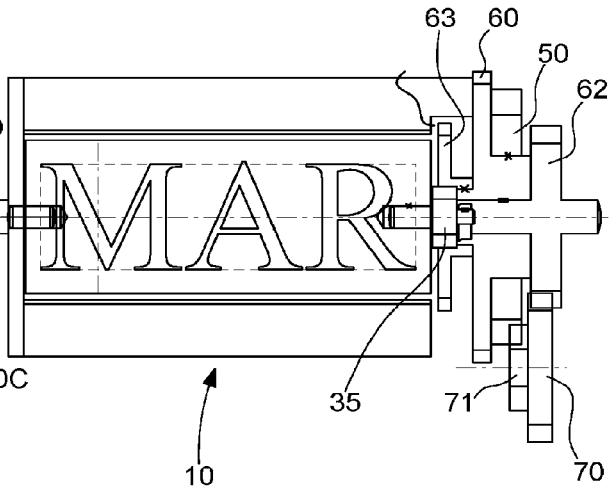

More particularly, FIGS. 19 and 20 illustrate a variant of this embodiment, which includes partial toothings. This variant is illustrated for a particular, non-limiting case of a version with five fixed positions, including two mobile flaps 20B and 20E with two faces, and without a Maltese cross.

A drive pinion of input train 61 (not represented) makes one revolution per day, and drives a main wheel 60, which makes 1/Nth, namely 1/7th of a revolution here, per day.

Main wheel 60 carries a main cam 50, which is separated into seven different peripheral sectors, the peripheral sectors may or may not include drive means (formed here by teeth 53), the concentric sectors 51 corresponding to the fixed display positions of roller 20, and the sectors with drive means 53 corresponding to the mobile positions of the display roller.

This main cam 50 cooperates with a 4-tooth star 71, held by a jumper (not represented). This 4-tooth star 71 is off-centre, pivots about a fixed point, and is arranged to pivot upon passage of a drive means, particularly of a tooth in the non-limiting embodiment illustrated.

Drive means 53, including teeth here, preferably combined with recesses 52, are arranged to mesh with teeth 72 of the 4-tooth star 71. However, when two successive teeth 72 of 4-tooth star 71 are simultaneously resting on a concentric sector 51, 4-tooth star 71 cannot rotate.

4-tooth star 71, pivoted on the plate, is thus arranged to make ¼ of a revolution per day, except for two days per week. In the illustrated example, once this star 71 has pivoted from Monday to Tuesday, it remains in its position on Tuesday and Wednesday, before changing position between Wednesday and Thursday. Likewise, when star 71 has pivoted from Friday to Saturday, it remains in its position on Saturday and Sunday, before changing position between Sunday and Monday. Flap 20B will display a first position on Tuesday, will pivot 180° from Tuesday to Wednesday, and display a second position on Wednesday. Likewise, flap 20E will display a first position on Saturday, will pivot 180° from Saturday to Sunday, and display a second position on Sunday. On the other days, the user will see fixed displays at the periphery of roller 20: 20A on Monday, 20C on Thursday, 20D on Friday.

This 4-tooth star 71 carries a secondary wheel 70, which meshes with a roller drive wheel 62, itself integral with display roller 10.

4-tooth star 71 consequently drives roller drive wheel 62 through 1/5th of a revolution, five out of seven days, which corresponds to the five fixed positions of the roller.

On the two additional days, 4-tooth star 71 remains resting on concentric sectors 51 and therefore cannot pivot. Roller drive wheel 62 is not driven, and roller 10 thus remains immobile.

Main wheel 60 also carries a main flap drive wheel 63, which in turn meshes with a flap pinion, arranged to control a flap drive pinion centred on flap axis D20 or actually forming a flap drive pinion 35.

This main flap drive wheel 63, like the main wheel, makes 1/7th of a revolution per day.

The flap pinions carry flaps 20B and 20E with two faces, and mesh with a ratio of 3.5 with main flap drive wheel 63.

Thus, when roller drive wheel 62 is immobile, and main wheel 60 makes 1/7th of a revolution, the flap pinion makes ½ a revolution, and the flap 20 concerned changes sides.

When roller drive wheel 62 is released and makes 1/5th of a revolution and main wheel 60 makes 1/7th of a revolution, the flap pinion makes 1/10th of a revolution, thus in 5 days it will return to its starting point.

Figure 24:
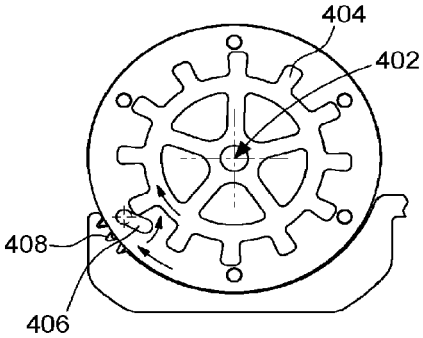
Figure 25:
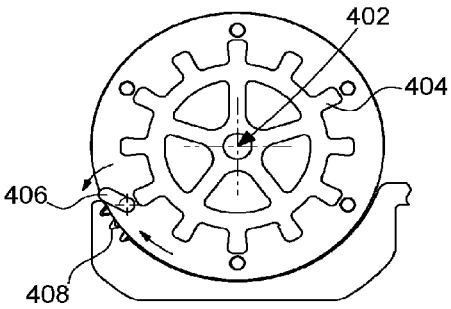
Figure 26:
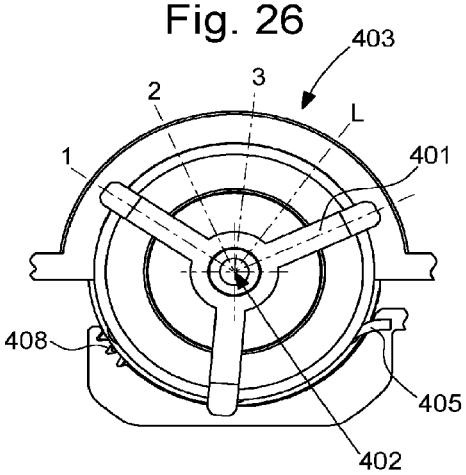

FIGS. 22 to 26 schematically represent a variant for a leap year display 400. This leap year display 400 may be achieved using one or more hands, particularly, but not limited in the example of the Figures to a triple hand 401 at 120°, in the extension of the month roller arbor 402, facing a complementary leap year display 403, notably including the usual markings, such as 1, 2, 3, L or B, or suchlike. A star 404, held by a jumper 405, drives this triple hand 401, and is driven in turn by an off-centre lever 406 integral with a flap 407. In the illustrated example, the rotation of star 404 occurs via an off-centre lever 406 integral with flap 407 for the months of March/September. When this flap 407 pivots via toothed sector 408, the latter pushes star 404 through one notch, as seen in FIGS. 24 and 25. The roller makes one revolution in six months, in July the lever does not cause the star to rotate.

Figure 27:
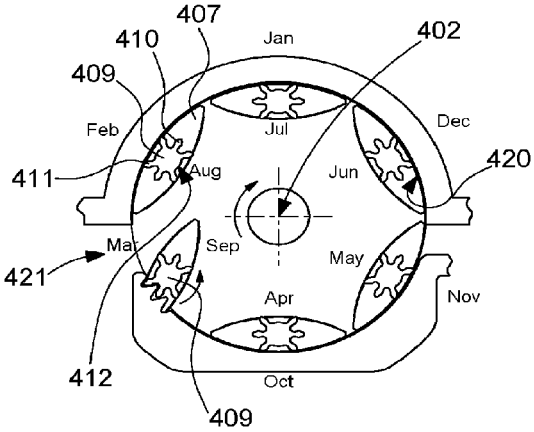
FIG. 27 represents, in a similar manner to FIG. 7, another variant for holding the flaps without a jumper, with driving by a partial toothing, and guiding by an external circumference in contact with the actual flap.

FIG. 27 represents another variant for holding flaps 407 without a jumper, and with driving by a partial toothing, and guiding by an external circumference 420 in contact with the actual flap 407. In particular, as seen in FIG. 27, flap 407 is guided into position by two teeth 410, 411, of its drive pinion 409. The latter may have one or more missing teeth, at a recess 412, to facilitate the function. Support is advantageously realized on a partial external or internal guide circumference, by two teeth delimiting a rotation circumference intersecting the guide circumference. This intersection limits the rotation of the rollers on their axes. The guide circumference is interrupted on a portion 421 permitting rotation. This rotation is controlled by a segment of toothing 408 provided for this purpose. The latter may, as in the Figure, form part of guide circumference 420.

Likewise, in a jumper-free flap variant, the flap may be guided directly by an external circumference in contact with the actual flap. In this manner, the guide circumference is interrupted to allow the flap to pass. The drive pinion may then have the configuration of the variant of FIGS. 7 to 11, or in that of FIGS. 17 and 18.

The different variants of the invention make it possible to produce roller displays for all sorts of indications in the reduced volume of a watch of normal dimensions, particularly with a total thickness on the order of 10 mm outside the crystals, or the crystal and case back. The flaps are not in contact with any part of the watch, and are not subjected to any shocks or friction during their normal operation.

What is claimed is:

1. A timepiece display mechanism comprising:

at least one roller pivoting about a roller axis, said roller comprising at least one flap pivoting about a flap axis parallel to said roller axis and distinct from said roller axis, said at least one flap comprising at least one first face and at least one second face;

first drive means for pivoting said roller about said roller axis;

second drive means distinct from said first drive means for pivoting at least one said flap about said respective flap axis, in at least one determined position of said flap axis relative to said roller axis, wherein said second drive means comprise, at each said flap, at least one flap drive pinion centred on each said flap axis and arranged to cooperate with a control means, comprised in said display mechanism, to modify, on demand, the position of said at least one flap or when said at least one flap is a plurality of flaps, to modify, in sequence or continuously, the position of said successive flaps of said at least one roller.

2. The display mechanism according to claim 1, wherein a constant rotation of said at least one flap according to said roller, is calculated so that, in the display position visible to the user, the indication of said at least one flap is rotated by 180° per revolution of said roller.

3. The display mechanism according to claim 1, wherein said at least one flap is a plurality of flaps and said second drive means are arranged to pivot only one of said flaps at a time, independently of the other said flaps comprised in said roller.

4. The display mechanism according to claim 3, wherein said second drive means are arranged to pivot said single flap in a single said specific position of said flap axis relative to said roller axis.

5. The display mechanism according to claim 1, wherein said second drive means are arranged to pivot synchronously each said flap comprised in said roller.

6. The display mechanism according to claim 1, wherein to hold each said flap in an orientation position, each comprises a flap cam or a heart-piece comprising as many low points as said flap has faces, and in that said roller includes at least one spring, arranged either to exert a force on a jumper disposed in proximity to each said flap cam or heart-piece to index the position of said flap cam or heart-piece, or forming said jumpers.

7. The display mechanism according to claim 1, wherein to hold each said flap in an orientation position, each comprises a flap cam or a heart-piece comprising as many low points as said flap has faces, and in that said roller includes, for each said flap cam or heart-piece, at least one magnet arranged to exert a force on said flap cam or heart-piece made of magnetic material to index the position of said flap cam or heart-piece.

8. The display mechanism according to claim 1, wherein first drive means include a control wheel some of whose teeth have been removed, and which meshes with a roller drive pinion, either directly, or via a pair of reduction gears, to obtain the desired reduction.

9. The display mechanism according to claim 1, wherein at least one said roller has at least one fixed display position and at least one mobile display position via said flap comprising said at least one first face and said at least one second face.

10. The display mechanism according to claim 9, wherein said first drive means include an input train which drives a main wheel, one revolution of which corresponds to the display time period of said roller, and which carries a main cam carrying peripheral sectors of unequal geometry, concentric sectors corresponding to the fixed display positions, and recessed sectors provided with drive pins corresponding to the mobile positions of said display roller, said main cam cooperating with a secondary, off-centre, Maltese cross cam, pivoting about a fixed point, and arranged to pivot upon passage of each said recessed sector and of each said pin, said secondary cam carrying a secondary wheel meshing with a roller drive wheel, and said main wheel also carrying a main flap drive wheel, which in turn meshes with a flap pinion, arranged to control a flap drive pinion centred on said flap axis or actually forming said flap drive pinion.

11. The display mechanism according to claim 9, wherein said first drive means include an input train which drives a main wheel, one revolution of which corresponds to the display time period of said roller, and which carries a main cam carrying peripheral sectors of unequal geometry, concentric sectors corresponding to the fixed display positions, and sectors including drive means close to recesses, said main cam cooperating with an off-centre star, pivoting about a fixed point, and arranged to pivot upon passage of said drive means, and to remain in the angular position thereof when two teeth comprised therein are resting on said concentric sector, said star carrying a secondary wheel, which meshes with a roller drive wheel, which is in turn integral with said roller, and said main wheel also carrying a main flap drive wheel, which in turn meshes with a flap pinion arranged to control a flap drive pinion centred on said flap axis or actually forming said flap drive pinion.

12. The display mechanism according to claim 1, wherein said display mechanism includes a leap year display by means of at least one hand in the extension of an arbor of a month roller, facing a complementary leap year display, and in which leap year display a star held by a jumper, drives said hand, and is driven in turn by an off-centre lever integral with a flap of said at least one flap arranged to pivot via a toothed sector.

13. The display mechanism according to claim 1, wherein said at least one flap of said display mechanism includes flaps without jumpers, and with driving by a partial toothing, and with guiding by an external circumference in direct contact with said said flaps, which is guided into position by two teeth, of the drive pinion thereof, which has one or more missing teeth in a recess, and in that said external circumference is interrupted over one portion permitting rotation of said flaps, which rotation is driven by a segment of toothing provided for such purpose, which may or may not form part of said external circumference.

14. A watch including at least one display mechanism according to claim 1.

* * * * *